US009120140B2

(12) United States Patent
Moision et al.

(10) Patent No.: US 9,120,140 B2
(45) Date of Patent: Sep. 1, 2015

(54) METHOD AND APPARATUS FOR CLEARING A RIVET FROM A RIVETING TOOL

(71) Applicant: Ford Motor Company, Dearborn, MI (US)

(72) Inventors: William C. Moision, Northville, MI (US); Loi V. Nguyen, Auburn Hills, MI (US)

(73) Assignee: Ford Motor Company, Dearborn, MI (US)

( * ) Notice: Subject to any disclaimer, the term of this patent is extended or adjusted under 35 U.S.C. 154(b) by 366 days.

(21) Appl. No.: 13/744,496

(22) Filed: Jan. 18, 2013

(65) Prior Publication Data

US 2014/0201977 A1 Jul. 24, 2014

(51) Int. Cl.

| | |
|---|---|
| ***B21J 15/32*** | (2006.01) |
| ***B21J 15/28*** | (2006.01) |
| ***B21J 15/02*** | (2006.01) |

(52) U.S. Cl.

CPC ..... *B21J 15/28* (2013.01); *B21J 15/025* (2013.01); *B21J 15/32* (2013.01); *Y10T 29/49956* (2015.01); *Y10T 29/53043* (2015.01)

(58) Field of Classification Search

CPC . Y10T 29/5307; Y10T 29/53; Y10T 29/5303; Y10T 29/53039; Y10T 29/53043; Y10T 29/53065

See application file for complete search history.

(56) References Cited

U.S. PATENT DOCUMENTS 5,259,104 A * 11/1993 Givler ..... 29/426.5
6,276,050 B1 8/2001 Mauer et al.

FOREIGN PATENT DOCUMENTS

WO 0007751 A1 2/2000

* cited by examiner

*Primary Examiner* — Richard Chang
(74) *Attorney, Agent, or Firm* — Damian Porcari; Brooks Kushman P.C.

(57) ABSTRACT

An apparatus, tool and method for clearing a rivet from an automated riveting tool. The riveting tool has a nose that supports the rivet as the rivet is installed by a punch. A clamping ring engages a work piece while installing the rivet. A clamping ring engages a block, but defines a clearance area into which the rivet is ejected when an unsuitable rivet is detected. A sensor monitors the rivets in the nose and prevents installation of the rivet when the rivet in the nose is not suitable for installation. System controls are provided to stop insertion of an unsuitable rivet while the robot continues to move the rivet tool through the complete cycle without inserting rivets until the unsuitable rivet is cleared.

20 Claims, 4 Drawing Sheets

METHOD AND APPARATUS FOR CLEARING A RIVET FROM A RIVETING TOOL

TECHNICAL FIELD

This disclosure relates to automated riveting tools that are used to install rivets in an assembly and a method of riveting that includes an automated routine for clearing a damaged or improper rivet from the tool.

BACKGROUND

Rivets are used to secure multiple parts together in an assembly. A self-piercing rivet is a tubular member including a head that is installed by a punch and a die that drive the rivet into a work piece. The tubular end of the self-piercing rivet is spread apart as it is installed to provide a permanent, leak proof joint.

A self-piercing riveting tool has a hollow nose through which the punch and rivet are guided prior to performing the riveting operation. The nose includes an outer ring that clamps the parts of the work piece together before the rivet is inserted into the work piece. Rivets can be damaged, jammed or miss-fed into the tool during the riveting process. Riveting tools can be used to insert a plurality of different types of rivets, different size rivets, or rivets made of different materials in the same part in predetermined locations. If a rivet is jammed in the nose of the rivet tool or the wrong type of rivet is provided to the tool, the rivet must be cleared to prevent damage to the tool or installation of the wrong type of rivet in the wrong location on the work piece.

The nose of a prior art riveting tool must be disassembled to clear a damaged, jammed or miss fed rivet from the riveting tool. Disassembly of the nose of the riveting tool may take several minutes or longer. In high production environments where multiple rivets are installed by a single riveting tool, after the tool is cleared the automation system must be reset. The time for clearing the damaged, jammed or miss fed rivet plus the time for resetting the automation system compromises the efficiency of the system.

The above problems and other problems are addressed by this disclosure as summarized below.

SUMMARY

According to one aspect of this disclosure, an apparatus for clearing a rivet from a riveting tool having a nose that supports a rivet as the rivet is installed by a punch. A clamping ring is operative to engage a work piece while installing the rivet. The apparatus comprises a block engaged by the clamping ring that defines a clearance area into which the rivet is moved when an unsuitable rivet is detected in the riveting tool.

According to other aspects of this disclosure, the clearance area may be an opening through the block. The clearance area may be an edge of the block. The block may be located at a fixed location in close proximity to the riveting tool.

According to another aspect of this disclosure, a tooling system is disclosed for installing a plurality of rivets in a plurality of locations on a work piece. The tooling system comprises a riveting tool having a ring encircling a punch that engages the work piece to drive the rivet into a work piece. The riveting tool has a nose that encloses the punch and receives the rivets. A robot moves the riveting tool in a programmed sequence to install the rivets in the plurality of locations. A sensor may monitor the presence of the rivet in the nose and the logic in the controller may check in memory the type of rivet previously loaded in the nose and prevent installation of the rivet when the rivet in the nose is not suitable for installation. A controller interrupts the programmed sequence when the rivet detection system prevents installation of a rivet and sets up the clear rivet cycle. The clear rivet cycle can be initiated automatically or manually depending upon the program configuration. During the clear rivet cycle, the ring of the riveting tool is moved into engagement with a block and the punch is cycled to clear the rivet from the nose. The riveting tool is then moved according to the programmed sequence. The clear rivet cycle can be performed manually by the operator for manual gun applications.

According to other aspects of this disclosure as it relates to the tooling system, the clear rivet cycle begins at a point in the sequence where the rivet that is not suitable for installation is detected. Once the clear rivet cycle is triggered, automatically or by manual intervention, the riveting tool continues through to an end of the programmed sequence without installing any rivets. The rivet is then cleared from the nose and the riveting tool then continues at the beginning of the programmed sequence until the point in the sequence where the rivet that was deemed not suitable for installation was detected. The riveting tool then resumes installing the rivets in the programmed sequence.

According to other aspects of the disclosure relating to the tooling system, the controller may interrupt the programmed sequence by inhibiting the punch from driving the rivet into the work piece. The rivet detection system may detect the type of rivet in the nose, the condition of the rivet in the nose, or whether the rivet is jammed in the nose.

According to another aspect of this disclosure, a method is disclosed for installing a plurality of rivets in a work piece with a riveting tool that is moved by a robot. The method comprises installing the rivets in the work piece in a programmed sequence and detecting that a rivet is not suitable for installation. A clear rivet cycle is then initiated by moving the riveting tool to a block that opposes a clamping ring of the riveting tool as a punch drives the rivet from the riveting tool into a clearance area defined by the block. The method continues by resuming installing the rivets in the programmed sequence.

According to other aspects of the method, the clear rivet cycle is setup when a rivet is detected that is not suitable for installation. Once the clear rivet cycle is triggered, automatically or by manual intervention, the riveting tool continues through to an end of the programmed sequence without installing any rivets, until the rivet is cleared from the riveting tool. The method may then continue at the beginning of the programmed sequence until the point in the sequence where the unsuitable rivet was identified and the riveting tool then resumes installing the rivets in the programmed sequence.

The above aspects of the disclosure are more fully described below with reference to the attached drawings.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1:
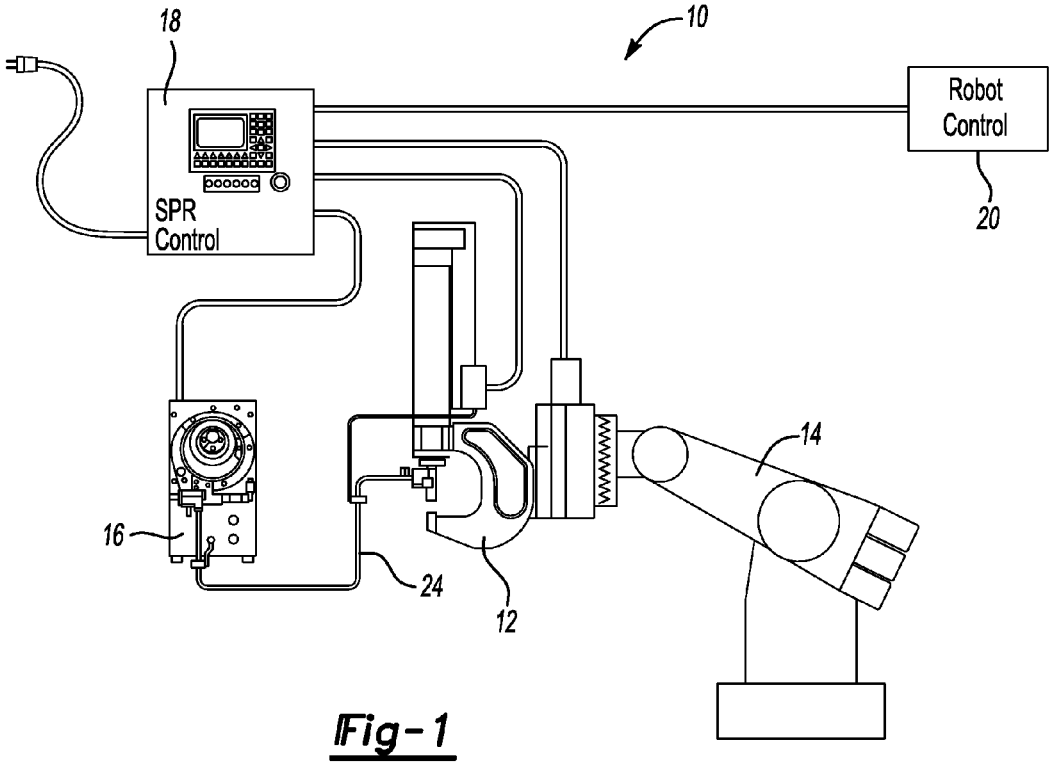
FIG. 1 is a diagrammatic view of an automated self-piercing riveting tool that includes a robot for moving and operating the riveting tool to install a plurality of rivets in a work piece.

Referring to FIG. 1, an automated self-piercing rivet (SPR) installation tool system is generally indicated by reference numeral 10. The system 10 includes a SPR tool 12 that is moved between riveting locations by a robot 14. It should be understood that automation systems may take different forms and that an automation apparatus could be used in place of the robot 14. A blow feed type of rivet feeder 16, or magazine, provides rivets (not shown in FIG. 1) to the SPR tool. A magazine feed or tape feed feed system may be used instead of the blow feed type of system. A SPR controller 18 controls operation of the SPR tool 12. A robot controller 20 controls operation of the robot 14. The SPR controller 18 and robot controller 20 are interfaced with each other and various control functions may be performed by either the SPR controller 18 or the robot controller 20. A rivet supply line 24, or tube, provides a supply of rivets from the rivet feeder 16 to the SPR tool 12.

Figure 2:
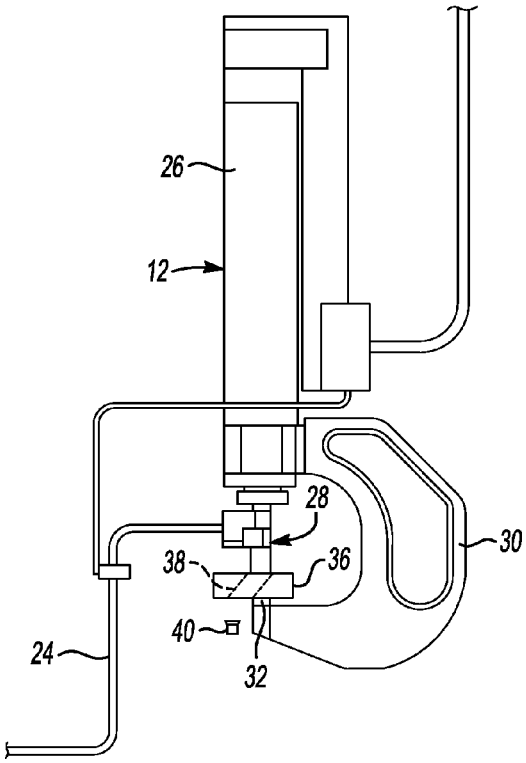
FIG. 2 is a side elevation view of the automated self-piercing riveting tool engaging a rivet clearing block that defines a rivet rejection opening.

Referring to FIG. 2, the SPR tool 12 is shown in greater detail. The rivet supply line 24 is shown feeding rivets to the SPR tool 12. The SPR tool 12 includes a servo motor actuator 26 that provides the force for driving the rivets into a work piece. A hydraulic actuator or a pneumatic actuator could be used instead of the illustrated servo motor actuator 26. The SPR tool 12 includes a nose 28 into which rivets are fed by the rivet supply line 24. A C-shaped jaw 30 forms part of the SPR tool 12 and supports a back-up 32 that is used to support the obverse side of a work piece during a riveting operation.

In one embodiment, a sensor 34 may be used to detect the presence of the rivet. The sensor may be a proximity sensor, a laser identification sensor, a scale, or other type of sensor. Alternatively, logic may be used to track the type, condition or orientation of a rivet in the nose 28. The logic may be resident in one or both of the SPR controller 18 and robot controller 20. The sensor 34 and logic may be used in combination to detect the type, condition, and orientation of the rivet 40. As used herein, the term "rivet detection system" should be interpreted to include a sensor 34, logic used to track the type, condition or orientation of a rivet in the nose 28, or a combination of the sensor 34 and logic.

A block 36 is provided to facilitate removing rivets from the nose 28 of the SPR tool 12. The block 36 includes a passageway 38, or opening, through which a rivet 40 may be driven to clear the rivet 40 from the SPR tool 12. The illustrated rivet is a countersink rivet 40, but it should be understood that a pan head or hex head rivet may also be used.

Figure 3:
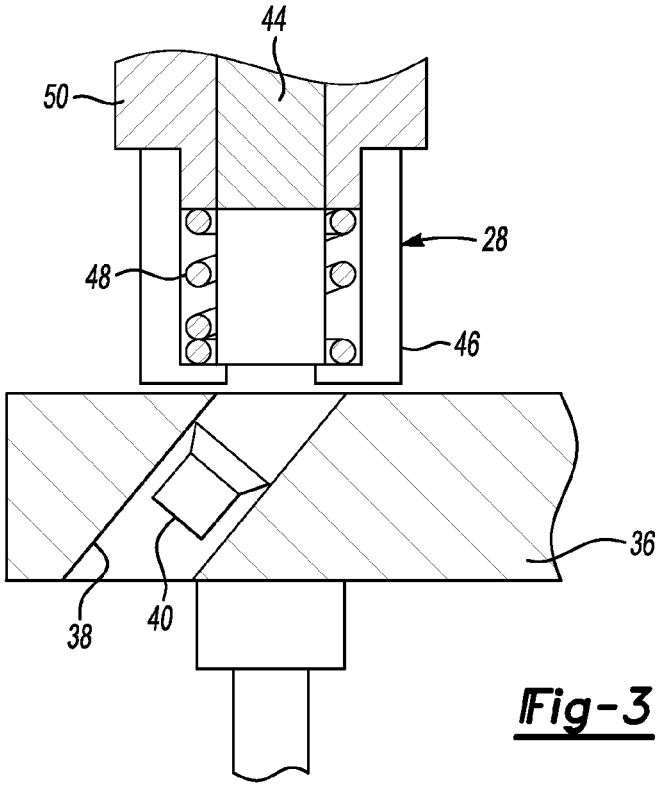
FIG. 3 is a fragmentary cross-sectional view of a nose of the automated self-piercing riveting tool and the rivet clearing block shown in FIG. 2.

Referring to FIG. 3, one embodiment of the block 36 is shown in which the nose 28 is shown in a fragmentary cross-sectional view. A punch 44 is disposed within and concentric to a ring 46. A helical mechanical spring 48 urges the ring 46 into engagement with the work piece or with the block 36 that includes passageway 38 for clearing a rivet 40. A hydraulic or pneumatic pre-clamp may be used instead of the mechanical spring 48. A body portion 50 of the SPR tool 12 retains the spring 48 and provides a reaction force to the spring 48 in the course of a riveting operation.

Figure 4:
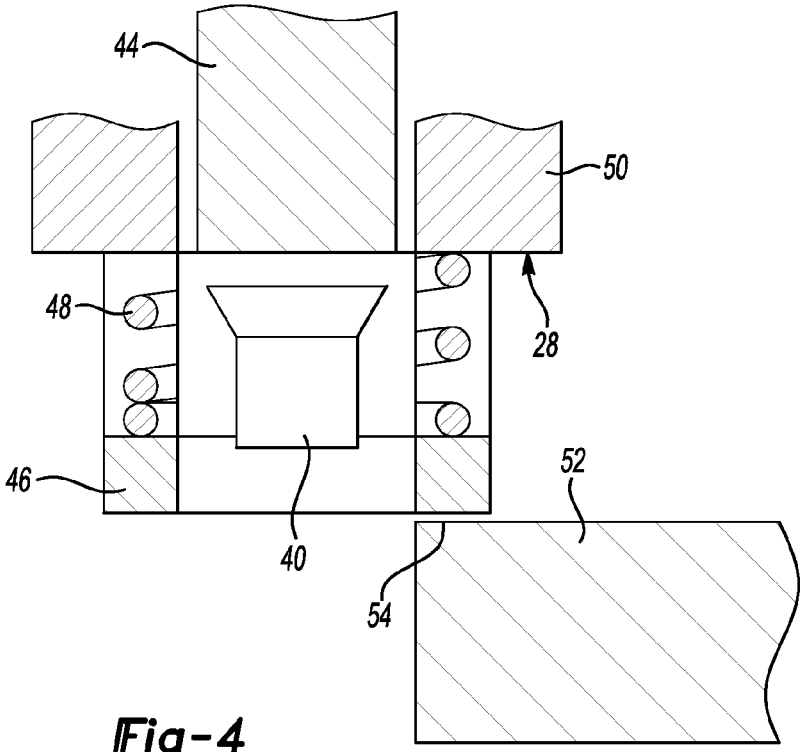
FIG. 4 is a fragmentary cross-sectional view of a nose of the automated self-piercing riveting tool and an alternative embodiment of a rivet clearing block that is engaged on an edge to reject the rivet.

Referring to FIG. 4, an alternative block 52 is shown that includes an edge 54. The SPR tool 12 may engage the edge 54 of the alternative block 52 to hold the ring 46 in place while the punch 44 reciprocates through a riveting cycle. In the embodiment of FIG. 4, the ring 46 only partially engages the block 52, while in the embodiment shown in FIG. 3, the ring engages the circumference of the passageway 38 in the block 36.

Figure 5:
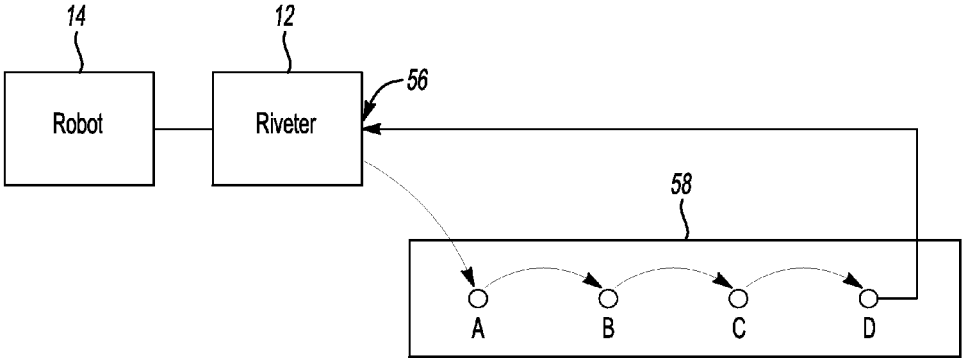
FIG. 5 is flow chart illustrating the normal sequence of operation for the automated self-piercing riveting tool and robot.
Figure 6:
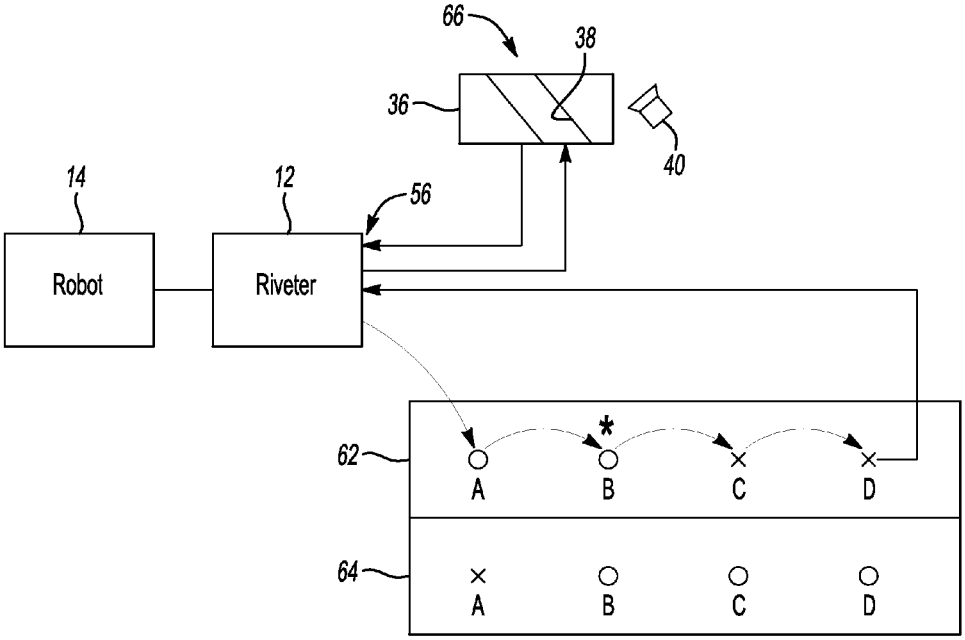
FIG. 6 is flow chart illustrating the reject rivet sequence for the automated self-piercing riveting tool and robot.

Referring to FIG. 5, a diagrammatic view illustrates a work piece 58 undergoing a normal riveting cycle. The robot 14 moves the SPR tool 12 from a location designated riveter home 56 and moves from A to B to C to D, installs rivets as indicated by "O" and returns to home. In contrast, FIG. 6 illustrates the robot 14 as it moves the SPR tool 12 from riveter home 56 on a work piece 62 that illustrates an interrupted riveting cycle. In FIG. 6, an interrupted cycle 62 is illustrated where a rivet is installed as indicated by "O" of A. A defective rivet or otherwise unacceptable rivet is detected at "B". At this point, the robot 14 continues to move the SPR tool 12 to C and D, but no rivet is installed as indicated by "X" at location C and D. Since the unacceptable condition was detected at B, no rivet is installed at B as indicated by "O".

After the robot 14 leaves location D, SPR tool 12 returns to the riveter home position 56. The robot 14 moves the SPR tool 12 to a rivet clearing station 66. The block 36 is illustrated at the rivet clearing station 66. The block includes the passageway 38, or opening, to which the rivet 40 is ejected by the punch as shown in FIG. 3. Upon clearing the rivet 40, the SPR tool 12 returns to the riveter home position and the riveting cycle begins again. No rivet is installed at A and riveting resumes as the robot 14 moves the SPR tool 12 from B to C to D before returning to the riveter home 56.

Figure 7:
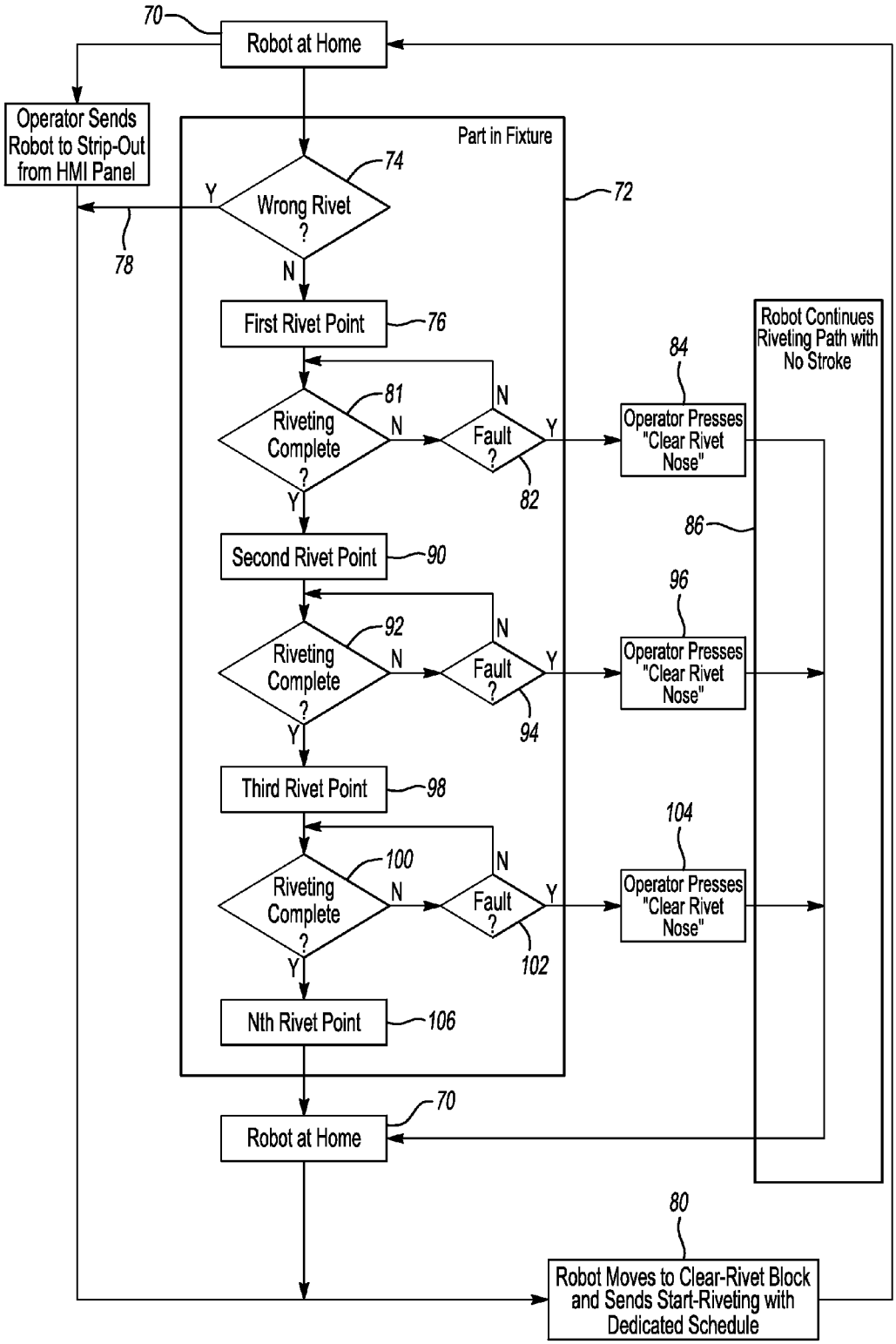
FIG. 7 is a flow chart illustrating an example of a logic sequence for controlling the automated self-piercing riveting tool and robot.

Referring to FIG. 7, a flowchart is provided to illustrate the logic sequence used to clear a rivet 40 from the nose 28 of the SPR tool 12 (not shown in FIG. 7). The description of the logic sequence begins at 70 with the robot at its home position. A work piece is loaded into a fixture, as diagrammatically represented as the box identified by reference numeral 72. Once the part is in the fixture, operation of the SPR tool 12 begins with a detector determining whether the wrong rivet 40 has been fed into the nose 28 of the SPR tool 12. If the correct rivet 40 is detected, the SPR tool proceeds to block 76 representing the first rivet point. If the wrong rivet 40 is fed into the nose 28, the riveting sequence is interrupted and the SPR tool 12 moves to the clear rivet block 80 where the clear rivet cycle is performed at the rivet clearing station 66 (shown in FIG. 6).

From the first rivet point 76, the robot waits for the riveting operation to be completed at the first rivet point 76. If the riveting operation at the first rivet point was not completed, it is determined whether or not there is a fault at block 82. If no fault has occurred, the system reverts back to block 81. If a fault is detected at 82, an operator may be prompted at 84 to initiate the clear rivet at nose cycle at 84. In an automatic or semi-automatic system the control logic may be used to start the clear rivet nose cycle at 84. The riveting operation is stopped and the robot continues to move the robot through the riveting path at 86 without installing any rivets at the subsequent riveting locations. The riveting cycle continues without riveting until the robot 12 returns the SPR tool to its home position at 70. From the home position, the robot moves the SPR tool 12 to the clear rivet block at 80. From 80, the robot returns to home at 70 and continues the riveting operation at the location where the robot previously left off.

Resuming the description of the process after successful insertion of a rivet at the first rivet point at 76, the robot moves the SPR tool 12 to the second rivet point at 90. A rivet is installed at 90 and the system checks to determine whether the riveting at the second rivet point was completed at 92. If not, a fault is determined at 94. If a fault has occurred, the operator may be prompted to press the clear rivet at nose 96. Alternatively, the system may be more fully automated by eliminating the need for an operator to press the clear rivet at nose button and the system may automatically direct the robot to continue riveting with no riveting stroke at 86 without intervention by an operator.

If the riveting is successfully completed at the third rivet point at block 98, the system checks at 100 as to whether the riveting was successfully completed. If not, again it is determined whether or not a fault has occurred and if so the system proceeds at 104 as previously described. If the riveting is determined to be completed at block 100, the system proceeds in like manner for the required number of rivets as represented at block 106. Upon completing all of the riveting operations, the robot returns the SPR tool 12 to home at 70.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An apparatus for clearing a rivet from a riveting tool having a nose that supports a rivet, and a clamping ring, the apparatus comprising:

means for detecting an unsuitable rivet in the nose; and a block engaged by the clamping ring, wherein the block defines a clearance area into which the unsuitable rivet is ejected into after the unsuitable rivet is detected and before inserting the rivet in a workpiece.

2. The apparatus of claim 1 wherein the clearance area is an opening through the block.

3. The apparatus of claim 1 wherein the clearance area is an edge of the block.

4. The apparatus of claim 1 wherein the block is disposed at a fixed location in close proximity to the riveting tool.

5. A tooling system for installing a plurality of rivets in a plurality of locations on a work piece comprising:

a riveting tool having a ring encircling a punch that engages the rivet to drive the rivet into a work piece, the riveting tool has a nose that encloses the punch and receives the rivets;

a robot moves the riveting tool in a programmed sequence to install the rivets in the plurality of locations;

a rivet detection system monitors the rivets in the nose and prevents installation of the rivet when the rivet is not suitable for installation; and a controller interrupts the programmed sequence when the rivet detection system prevents installation of a rivet and sets up a clear rivet cycle, wherein during the clear rivet cycle the ring of the riveting tool is moved into engagement with a block and the punch is cycled to clear the rivet from the nose, and is then moved in the programmed sequence.

6. The tooling system of claim 5 wherein the clear rivet cycle is setup at a point in the sequence where the rivet that is not suitable for installation is detected and depending upon the configuration of the control system, the riveting tool continues through to an end of the programmed sequence without installing any rivets, until the rivet is cleared from the nose, the riveting tool then continues at the beginning of the programmed sequence until the point in the sequence where the rivet that was deemed not suitable for installation, and wherein the riveting tool resumes installing the rivets in the programmed sequence.

7. The tooling system of claim 5 wherein the controller interrupts the programmed sequence by inhibiting the punch from driving the rivet into the work piece.

8. The tooling system of claim 5 wherein the rivet detection system detects a type of rivet in the nose.

9. The tooling system of claim 5 wherein the rivet detection system detects a condition of the rivet in the nose.

10. The tooling system of claim 5 wherein the rivet detection system detects whether the rivet is jammed in the nose.

11. The tooling system of claim 5 wherein the block defines a clearance area adjacent to a surface that engages the ring of the nose as the punch drives the rivet into the clearance area.

12. The tooling system of claim 11 wherein the clearance area is an opening through the block.

13. The tooling system of claim 11 wherein the clearance area is an edge of the block.

14. A method of installing a plurality of rivets in a work piece with a riveting tool that is moved by a robot, the method comprising:

installing the rivets in a programmed sequence in the work piece;

detecting that a rivet is not suitable for installation;

initiating a clear rivet cycle by moving the riveting tool to a block that opposes a clamping ring of the riveting tool as a punch drives the rivet from the riveting tool into a clearance area defined by the block; and resuming installing the rivets in the programmed sequence.

15. The method of claim 14 wherein the clear rivet cycle begins at a point in the sequence where a rivet that is not suitable for installation is detected, wherein the riveting tool continues through to an end of the programmed sequence without installing any rivets, until the rivet is cleared from the riveting tool that then continues at the beginning of the programmed sequence until the point in the sequence where the rivet that was deemed not suitable for installation, and wherein the riveting tool resumes installing the rivets in the programmed sequence.

16. The method of claim 15 further comprises inhibiting the punch from driving the rivet into the work piece during the clear rivet cycle.

17. The method of claim 15 wherein during the detecting step a sensor detects a type of rivet in the nose.

18. The method of claim 15 wherein during the detecting step a sensor detects a condition of the rivet in the nose.

19. The method of claim 15 wherein during the detecting step a sensor detects whether the rivet is jammed in the riveting tool.

20. The method of claim 15 wherein the clearance area is adjacent to a surface that engages the riveting tool as the punch drives the rivet into the clearance area.

* * * * *